US007398667B2

(12) United States Patent
Matsubara et al.

(10) Patent No.: US 7,398,667 B2
(45) Date of Patent: Jul. 15, 2008

(54) DIE CUSHION DRIVE SYSTEM

(75) Inventors: Shunsuke Matsubara, Yamanashi (JP); Shinichi Horikoshi, Yamanashi (JP); Takashi Okamoto, Yamanashi (JP); Yuuichi Yamada, Yamanashi (JP)

(73) Assignee: Fanuc Ltd, Yamanashi (JP)

( * ) Notice: Subject to any disclaimer, the term of this patent is extended or adjusted under 35 U.S.C. 154(b) by 282 days.

(21) Appl. No.: 11/282,636

(22) Filed: Nov. 21, 2005

(65) Prior Publication Data

US 2006/0107723 A1 May 25, 2006

(30) Foreign Application Priority Data

Nov. 22, 2004 (JP) ..... 2004-337976

(51) Int. Cl.
*B21J 9/18* (2006.01)

(52) U.S. Cl. ..... 72/454; 72/29.2

(58) Field of Classification Search ..... 72/28.1, 72/29.2, 350, 351, 443, 454; 318/801, 803
See application file for complete search history.

(56) References Cited

U.S. PATENT DOCUMENTS 4,772,830 A * 9/1988 Kobari et al. ..... 318/563
4,967,133 A * 10/1990 Hasegawa ..... 318/798
5,435,166 A 7/1995 Sunada
5,814,954 A * 9/1998 Suzuki et al. ..... 318/376
6,189,352 B1 * 2/2001 Salzmann et al. ..... 72/14.3
6,526,800 B1 * 3/2003 Virtanen et al. ..... 72/452.9
7,106,023 B2 * 9/2006 Ota et al. ..... 318/803

FOREIGN PATENT DOCUMENTS

JP 61-115627 A 6/1986
JP 07-195129 A 8/1995

* cited by examiner

*Primary Examiner*—Edward Tolan
(74) *Attorney, Agent, or Firm*—Drinker Biddle & Reath LLP

(57) ABSTRACT

A die cushion drive system provided with a servo motor serving as a source of drive power for a die cushion of a press machine and a power circuit with a regeneration function which regenerates energy from the servo motor and returns it to an AC power supply, whereby it is possible to power the die cushion drive system by a servo motor and return the regenerated energy of this servo motor to the power source so as to save on energy.

6 Claims, 5 Drawing Sheets

DIE CUSHION DRIVE SYSTEM

BACKGROUND OF THE INVENTION

1. Field of the Invention

The present invention relates to a die cushion drive system of a press machine, more particularly relates to a die cushion drive system powered by a servo motor.

2. Description of the Related Art

Oil pressure has been used as the source of drive power of a die cushion of a press machine in the related art.

FIG. 5 is a side view showing the configuration of a die cushion drive system of a press machine of the related art. In the figure, 51 indicates a slide moving vertically to press sheet metal or another worked object (not shown), 52 a die cushion for applying pressure upward to the worked object, 53 a motor for driving the slide 51, 54 a mechanism for converting the rotational energy of the motor to energy of vertical motion, 55 an arm for giving this vertical motion energy to the slide 51, 56 an oil pressure cylinder, 57 an oil pressure pipe, and 58 an oil pressure apparatus.

At the time of power operation, the energy from the motor 53 is used to make the slide 51 move downward and oil is transmitted from the oil pressure apparatus 58 through the oil pressure pipe 57 to the oil pressure cylinder 56, whereby the die cushion 52 is pushed upward and the worked object is worked.

In the above oil pressure type die cushion drive system of the related art, when the force from the slide 51 to the die cushion 52 is higher than the force from the die cushion 52 to the slide 51, energy is transmitted in the direction of the illustrated bold arrows and radiated from the oil pressure apparatus 58 as heat, so there was the problem that energy was wastefully consumed.

SUMMARY OF THE INVENTION

An object of the present invention is to power a die cushion drive system by a servo motor and return the regenerated energy of this servo motor to the power supply so as to save energy.

To achieve this object, according to a first aspect of the present invention, there is provided a die cushion drive system provided with a servo motor serving as a source of drive power for a die cushion of a press machine and a power circuit with a regeneration function which regenerates energy from the servo motor and returns it to an AC power supply.

In a second aspect of the present invention, the power circuit with a regeneration function is an inverter device provided with a converter circuit for converting alternating current from the AC power supply to direct current and an inverter circuit for converting the converted direct current to an alternating current to be supplied to the servo motor.

In a third aspect of the present invention, the converter circuit is provided with devices each comprised of a pair of a diode and a transistor, the diode being connected between an emitter and collector of the transistor in the forward direction, and the devices of the converter circuit increase the rated current of the transistors over the rated current of the diodes.

In a fourth aspect of the present invention, the inverter circuit is provided with devices each comprised of a pair of a diode and a transistor, the diode being connected between an emitter and collector of the transistor in the forward direction, and the devices of the inverter circuit increase the rated current of the diodes over the rated current of the transistors.

In a fifth aspect of the present invention, the power circuit with a regeneration function is provided with a resistance regenerating means enabling it to maintain the die cushion function even when the power regeneration function of the devices no longer operates.

In a sixth aspect of the present invention, the power circuit with a regeneration function is a matrix converter.

In a seventh aspect of the present invention, the converter circuit is a sine wave converter circuit controlling the power source current to a sine wave.

According to the first and second aspects of the present invention, the die cushion of the press machine receives the energy of the slide at each operation cycle, so almost all of the operation of the servo motor driving the die cushion becomes a regeneration operation. For this reason, the energy is returned through the servo motor from the inverter device to the AC power supply side and that energy can be utilized by other apparatuses, so an energy saving effect is obtained.

In the third and fourth aspects of the present invention, in the design of the inverter device, the devices can be designed so that the magnitude of the current flowing through the inverter device at the time of a regeneration operation is larger than the magnitude of the current flowing through the inverter device at the time of a power operation so as to optimize the design to the operation of the servo motor and thereby obtain the effects of a reduction of size and cost of the inverter device.

According to the fifth aspect of the present invention, by giving the resistance regeneration function, it is possible to receive the energy from the slide side and maintain the die cushion function so as to prevent damage to the machine even when there is an abnormality in the power supply or otherwise when the power regeneration function no longer operates.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
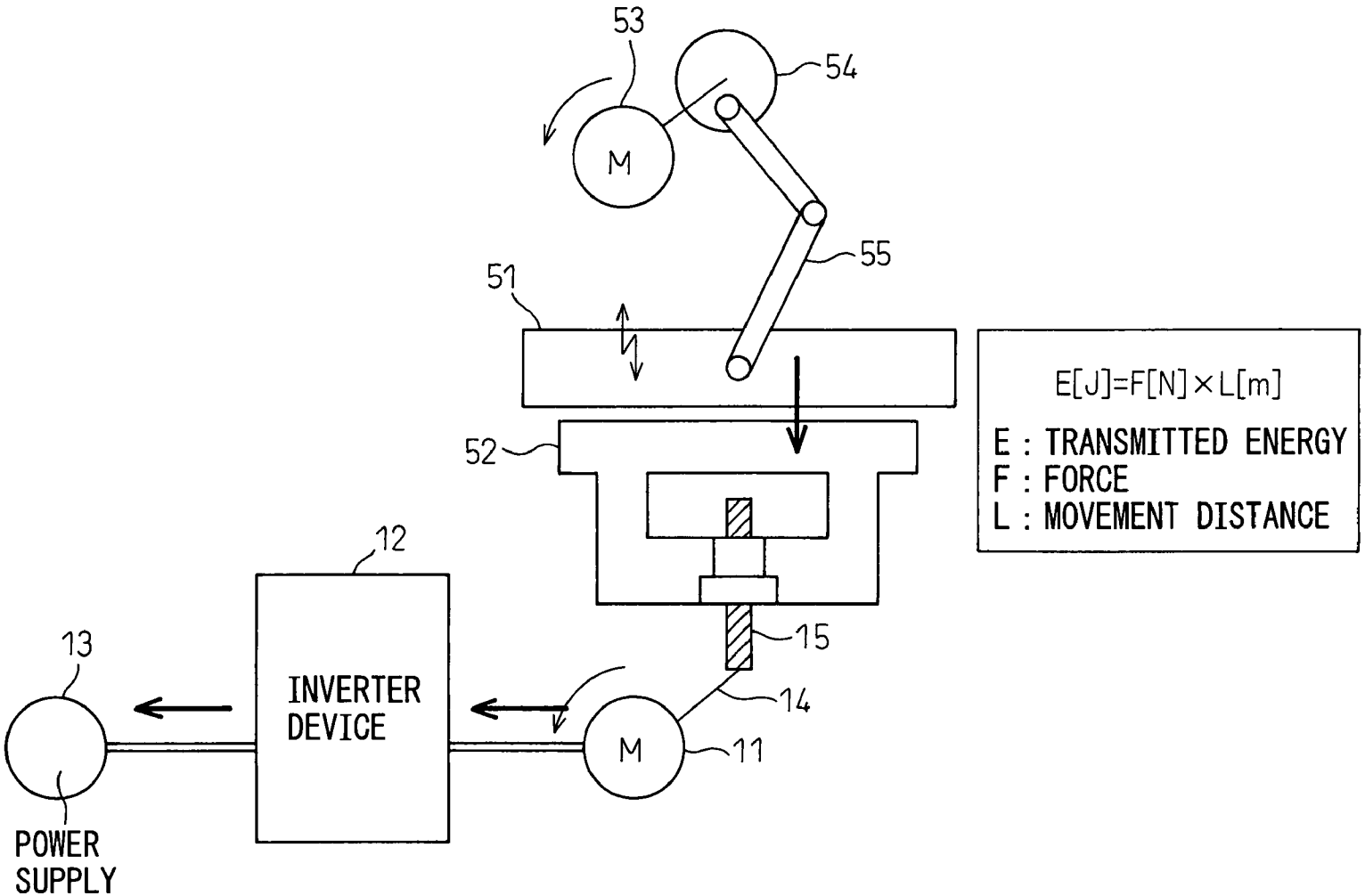
FIG. 1 is a side view showing the configuration of a die cushion drive system of a press machine according to an embodiment of the present invention.
Figure 5:
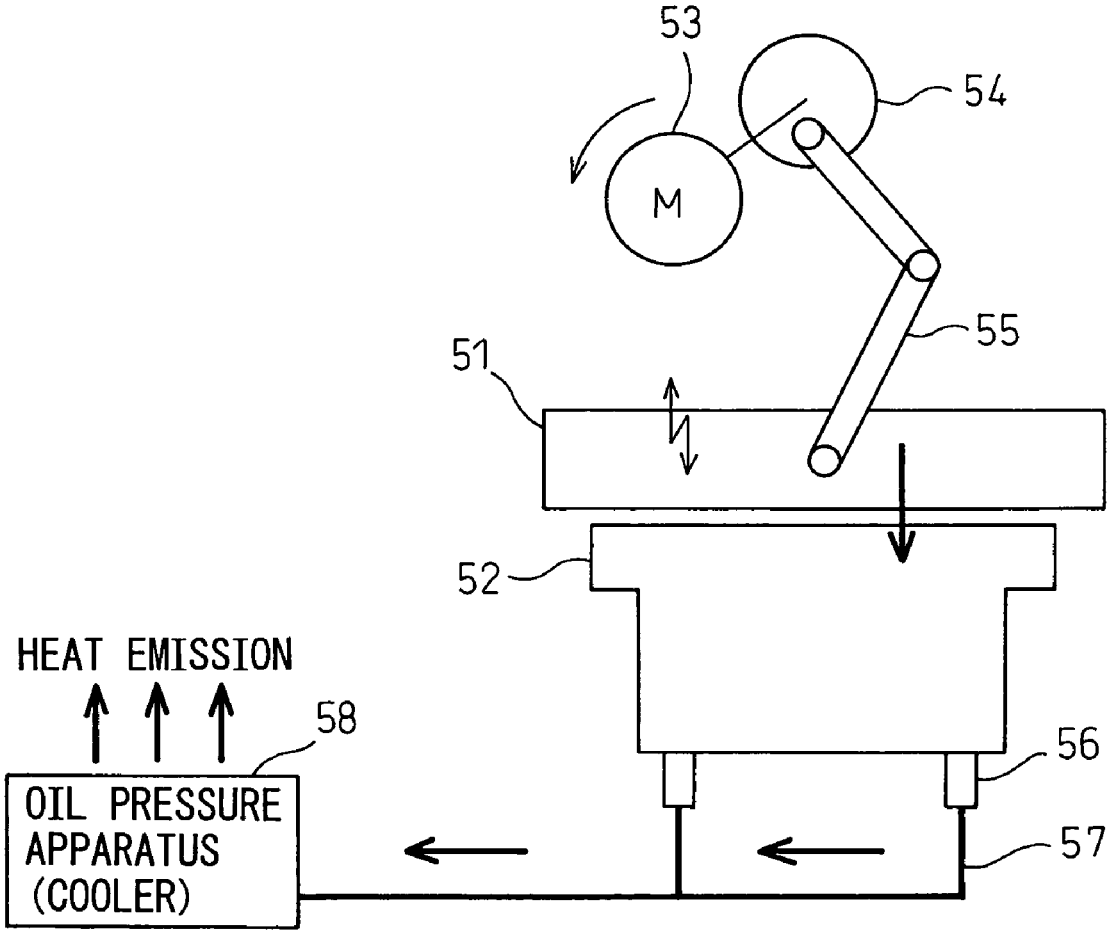
FIG. 5 is a side view of the configuration of a die cushion drive system of a press machine of the related art.

FIG. 1 is a side view of the configuration of a die cushion drive system of a press machine according to an embodiment of the present invention. In the figure, parts the same as those of the configuration of the related art shown in FIG. 5 are assigned the same reference numerals and explanations are omitted. In this embodiment, a servo motor 11 for driving the die cushion 52, an inverter device 12 for supplying AC power to the servo motor 11, and a three-phase AC power supply 13 for supplying power to the inverter device 12 at the time of a power operation are provided. The rotational energy of the servo motor 11 is given through a ball screw 14 to a shaft 15 of the die cushion 52 as vertical motion energy.

At the time of power operation, energy from the motor 53 is used to cause the slide 51 to move downward, and the inverter device 12 converts the alternating current from the three-phase AC power supply 13 to an alternating current having a frequency and amplitude optimal for driving the servo motor 12 and uses this to drive the servo motor 11, whereby the die cushion 52 is pushed upward.

When the energy from the motor 54 is larger than the energy from the servo motor 11, when the servo motor is being braked, and otherwise at the time of regeneration, the regenerated energy flows in the direction of the illustrated bold arrows and is regenerated at the three-phase AC power supply. The regenerated energy E at this time is the product of the force F given by the motor 53 to the slide 51 and the distance of movement L of the slide 51.

Figure 2:
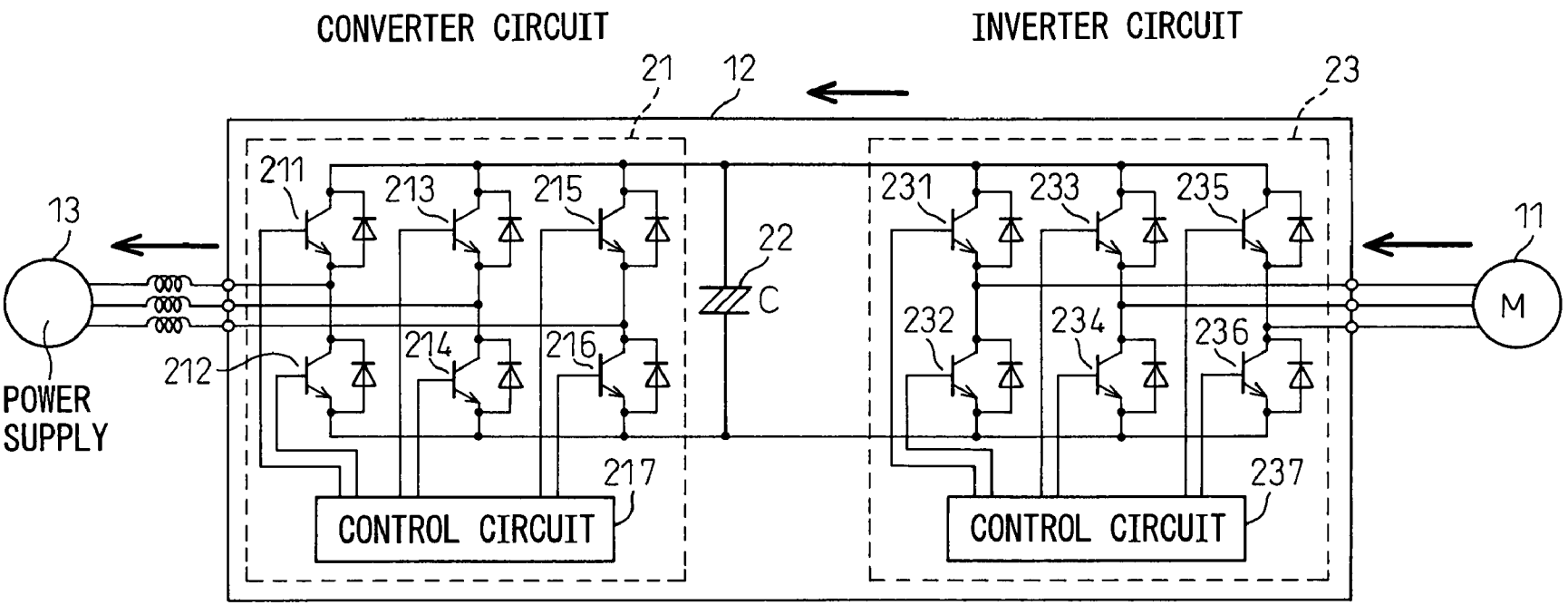
FIG. 2 is a circuit diagram of a circuit according to the first embodiment of the inverter device 12 shown in FIG. 1.

FIG. 2 is a circuit diagram of a circuit according to a first embodiment of the inverter device 12 shown in FIG. 1. In the figure, the inverter device 12 is provided with a converter circuit 21 for converting the three-phase alternating current from the three-phase AC power supply 13 to a direct current, a capacitor 22 for smoothening the direct current, and an inverter circuit 23 for converting the smoothened direct current to an alternating current of a frequency optimal for the drive of the servo motor 11.

The converter circuit 21 is comprised of six devices 211 to 216 each comprised of a diode and a transistor connected in parallel and of a control circuit 217. Each of the devices 211 to 216 is comprised of an NPN transistor and diode connected in parallel. That is, the diode is connected between the emitter and collector of the NPN transistor in the forward direction. The emitter of the transistor 211 and the collector of the transistor 212 are connected, the emitter of the transistor 213 and collector of the transistor 214 are connected, and the emitter of the transistor 215 and collector of the transistor 216 are connected. The phases of the three-phase AC power supply 13 are connected to these connection points. The collectors of the transistors 211, 213, and 215 are connected, the emitters of the transistors 212, 214, and 216 are connected, and the bases of the transistors 211 to 216 are supplied with control signals for turning on these transistors at suitable timings at the time of regeneration from the control circuit 217.

The inverter circuit 23 is comprised of six devices 231 to 236 each consisting of a diode and transistor connected in parallel and of a control circuit 237. Each of the devices 231 to 236 is comprised of an NPN transistor and diode connected in parallel. That is, the diode is connected between the emitter and collector of the NPN transistor with its positive pole in the forward direction. The emitter of the transistor 231 and the collector of the transistor 232 are connected, the emitter of the transistor 233 and the collector of the transistor 234 are connected, and the emitter of the transistor 235 and the collector of the transistor 236 are connected. Phases of the servo motor 11 are connected to these connection points. The collectors of the transistors 231, 233, and 235 are connected, the emitters of the transistors 232, 234, and 236 are connected, and the bases of the transistors 231 to 236 are supplied with control signals for turning on these transistors at suitable timings at the time of power operation from the control circuit 237.

Next, the operation of the circuit shown in FIG. 2 will be explained. At the time of power operation, the three-phase alternating current from the three-phase AC power supply 13 is converted to direct current by flowing through the diodes of the devices 211 to 216. This is then smoothed by the smoothening capacitor 22 and converted by the inverter circuit to an alternating current of a frequency optimal for driving the servo motor 11 by supply of a control signal from the control circuit 237 to the bases of the transistors 231 to 236. The thus obtained alternating current is supplied to the phases of the servo motor 11.

At the time of regeneration, the regenerated current from the servo motor 11 flows in the direction of the illustrated bold arrows, flows mainly in the diodes in the inverter circuit 23, flows mainly in the transistors in the converter circuit 21, and thereby is regenerated at the three-phase AC power supply 13.

Therefore, in the inverter circuit 23, for a period longer than the time of the regeneration operation, the magnitude of the allowable current of the diode through which the current flows is made larger than that of the transistor, while in the converter circuit 21, for a period longer than the time of the regeneration operation, the magnitude of the allowable current of the transistor through which the current flows is made larger than that of the diode. In this way, by optimizing the design of the devices considering the conditions of use of the devices, the heat generation is reduced and the apparatus can be made smaller in size.

Figure 3:
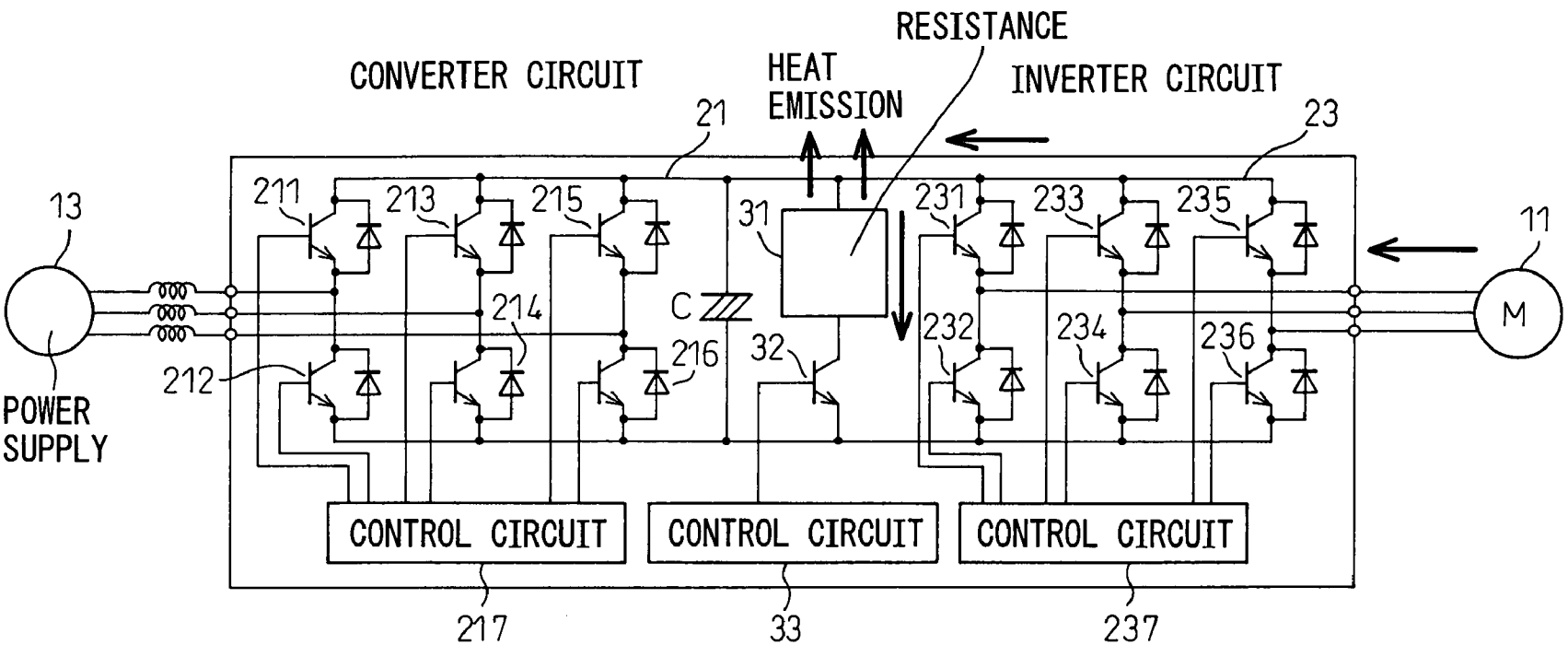
FIG. 3 is a circuit diagram of a circuit according to another embodiment of the inverter device 12 shown in FIG. 1.

FIG. 3 is a circuit diagram of the circuit according to another embodiment of the inverter device 12 shown in FIG. 1. In the figure, the difference from FIG. 2 is the addition of a resistance heater 31, a switching transistor 32, and a control circuit 33 forming a resistance regenerating means. One of the terminals of the resistance heater 31 is connected to the collectors of the transistors in the devices 211, 213, 215, 231, 233, and 235. The other terminal of the resistance heater 31 is connected to the collector of the NPN transistor 32. The emitter of the NPN transistor 32 is connected to the collectors of the devices 212, 214, 216, 232, 234, and 236. When driving the die cushion, the control signal from the control circuit 33 is supplied to the base of the transistor 32, whereby the transistor 32 becomes turned on. By providing this resistance regenerating means, even when there is an abnormality in the power supply or otherwise when the power regeneration function no longer operates, it is possible to receive the energy from the slide 51 side and maintain the die cushion function and thereby reduce damage to the machine.

In the circuits of FIG. 2 and FIG. 3, the control by the control circuits 217 and 237 is PWM control, but the present invention is not limited to PWM control. Similar regeneration operation can be realized by any other pulse control as well.

Further, according to another embodiment of the present invention, the control by the control circuits 217 and 237 may be control using a sine wave converter controlling the power source current at the time of power regeneration to a sine wave.

Figure 4:
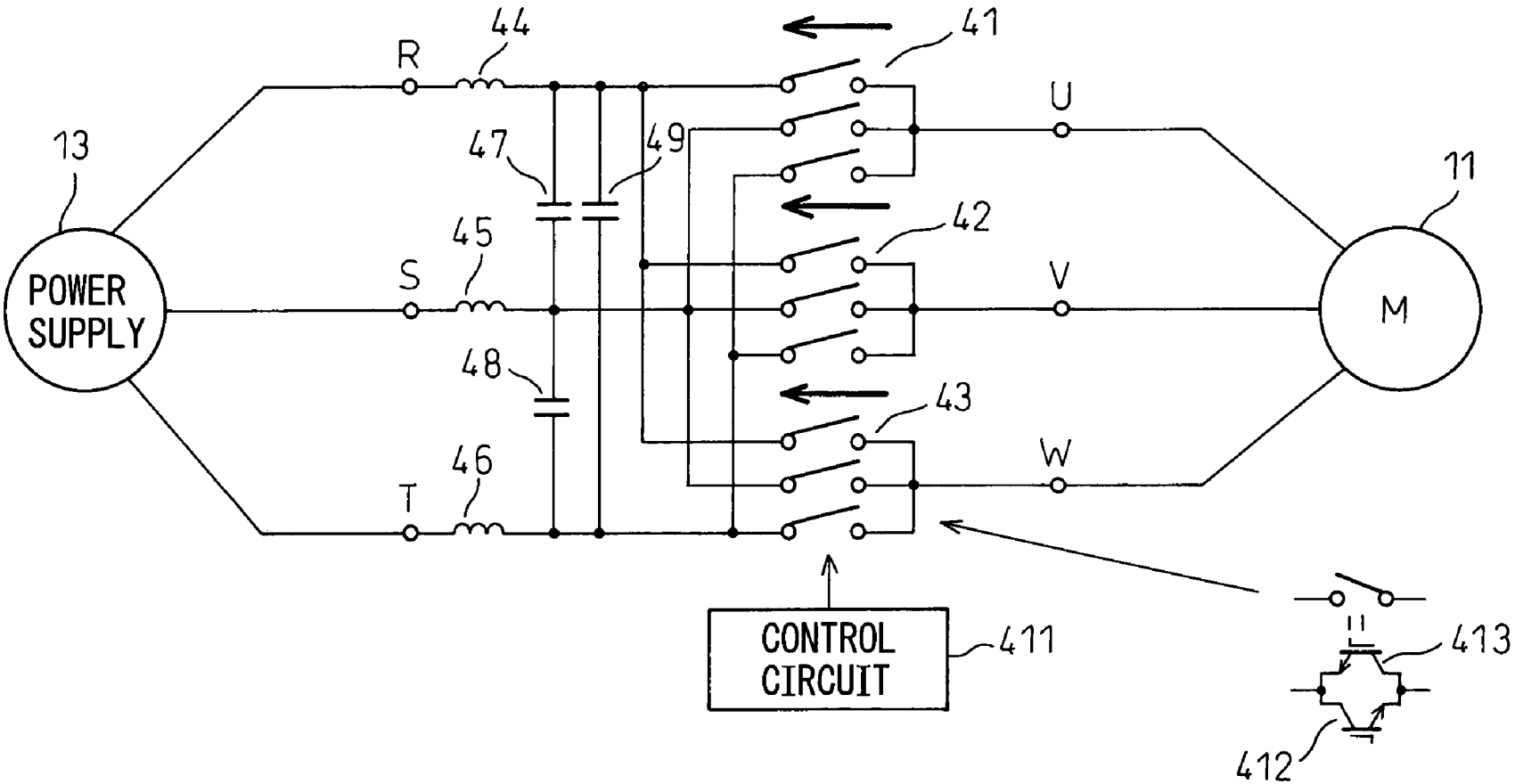
FIG. 4 is a circuit diagram of a power circuit with a regeneration function according to still another embodiment of the present invention.

FIG. 4 is a circuit diagram of the power circuit with a regeneration function according to still another embodiment of the present invention. In the figure, this power circuit with a regeneration function is an AC-AC converter constituted by a matrix converter. This matrix converter is provided with three two-way switches 41 connected to a U-phase of a servo motor 11, three two-way switches 42 connected to the V-phase, three two-way switches 43 connected to the W-phase, an inductor 44 connected to the R-phase of a three-phase AC power supply, an inductor 45 connected to the S-phase, an inductor 46 connected to the T-phase, a capacitor 47 connected between the R-phase and S-phase, a capacitor 48 connected between the S-phase and T-phase, a capacitor 49 connected between the R-phase and T-phase, and a control circuit 411 controlling the two-way switches 41, 42, and 43. The first switches of the two-way switches 41, 42, and 43 are connected to the R-phase side of the three-phase AC power supply 13, the second ones to the S-phase side of the three-phase AC power supply 13, and the third ones to the T-phase side of the three-phase AC power supply 13.

Each of the two-way switches is comprised of two NPN transistors connected in parallel. That is, the emitter of the NPN transistor 411 and the collector of the NPN transistor 412 are connected and the collector of the NPN transistor 411 and the emitter of the NPN transistor 412 are connected to configure it.

At the time of operation, the control circuit 411 gives a PWM control signal or other suitable control signal to the two-way switch so that, at the time of power operation, current flows to the NPN transistor 411, while at the time of regeneration, current flows to the NPN transistor 412, so that at the time of power operation, the servo motor 11 is supplied with suitable alternating current and at the time of regeneration, regenerated energy flows in the direction of the illustrated bold arrows and is returned to the three-phase AC power supply 13.

Summarizing the effects of the invention, since the inverter device for driving the die cushion of the press machine is given a power regeneration function, it is possible to realize energy savings.

While the invention has been described with reference to specific embodiments chosen for purpose of illustration, it should be apparent that numerous modifications could be made thereto by those skilled in the art without departing from the basic concept and scope of the invention.

The invention claimed is:

1. A die cushion drive system provided with a servo motor serving as a source of drive power for a die cushion of a press machine and a power circuit with a regeneration function which regenerates energy from the servo motor and returns it to an AC power supply, wherein the power circuit with a regeneration function is an inverter device provided with a converter circuit for converting alternating current from the AC power supply to direct current and an inverter circuit for converting the converted direct current to an alternating current to be supplied to the servo motor.

2. A die cushion drive system as set forth in claim 1, wherein the converter circuit is provided with devices each comprised of a pair of a diode and a transistor, the diode being connected between an emitter and collector of the transistor in the forward direction, and the devices of the converter circuit increase the rated current of the transistors over the rated current of the diodes.

3. A die cushion drive system as set forth in claim 2, wherein the power circuit with a regeneration function is provided with a resistance regenerating means enabling it to maintain the die cushion function even when the power regeneration function of the devices no longer operates.

4. A die cushion drive system as set forth in claim 1, wherein the inverter circuit is provided with devices each comprised of a pair of a diode and a transistor, the diode being connected between an emitter and collector of the transistor in the forward direction, and the devices of the inverter circuit increase the rated current of the diodes over the rated current of the transistors.

5. A die cushion drive system as set forth in claim 1, wherein the power circuit with a regeneration function is a matrix converter.

6. A die cushion drive system as set forth in claim 1, wherein the converter circuit is a sine wave converter circuit controlling the power source current to a sine wave.

* * * * *